US008627691B2

(12) United States Patent
Jeong et al.

(10) Patent No.: US 8,627,691 B2
(45) Date of Patent: Jan. 14, 2014

(54) ROTATING TUB BODY AND DRUM-TYPE WASHING MACHINE HAVING THE SAME

(75) Inventors: Haeng Maan Jeong, Suwon-si (KR); Byoung Mock Kahm, Suwon-si (KR); Hong Yeol Lee, Yongin-si (KR)

(73) Assignee: Samsung Electronics Co., Ltd., Suwon-Si (KR)

( * ) Notice: Subject to any disclaimer, the term of this patent is extended or adjusted under 35 U.S.C. 154(b) by 0 days.

(21) Appl. No.: 13/569,557

(22) Filed: Aug. 8, 2012

(65) Prior Publication Data

US 2012/0304705 A1 Dec. 6, 2012

Related U.S. Application Data

(63) Continuation of application No. 12/081,600, filed on Apr. 17, 2008, now Pat. No. 8,256,248.

(30) Foreign Application Priority Data

Jun. 7, 2007 (KR) ..... 10-2007-0055701

(51) Int. Cl.
*D06F 21/00* (2006.01)
*D06F 23/00* (2006.01)
*D06F 25/00* (2006.01)

(52) U.S. Cl.
USPC ..... 68/142; 68/3 R

(58) Field of Classification Search
USPC ..... 68/142
See application file for complete search history.

(56) References Cited

U.S. PATENT DOCUMENTS

2003/0074932 A1 4/2003 No et al.
2005/0252253 A1 11/2005 Ahn
2005/0252254 A1 11/2005 Kim

FOREIGN PATENT DOCUMENTS

EP 866161 A2 9/1998
KR 10-2006-0107036 10/2006

OTHER PUBLICATIONS

Office Action issued in parent U.S. Appl. No. 12/081,600 dated, Dec. 9, 2010.
Roppelt et al., Sep. 1998, EP 0866161A2, English machine translation.
Office Action issued in parent U.S. Appl. No. 12/081,600 dated, Mar. 22, 2011.
Notice of Allowance issued in parent U.S. Appl. No. 12/081,600 dated, May 16, 2012.
U.S. Appl. No. 12/081,600, filed Apr. 17, 2008, Haeng Maan Jeong et al., Samsung Electronics Co., Ltd.

*Primary Examiner* — Jason Ko
(74) *Attorney, Agent, or Firm* — Staas & Halsey LLP

(57) ABSTRACT

A cylindrical rotating tub body and a drum-type washing machine having the same, in which the rotating tub body is formed by rolling a plate such that both ends of the plate are connected to each other. The washing machine includes a cylindrical rotating tub body and a plurality of lifters, which are spaced apart from each other on an inner peripheral surface of the rotating tub body. The rotating tub body includes lifter installation sections on which a plurality of lifters are installed, concave-convex sections having a plurality of concave-convex parts and being installed between the lifter installation sections, and reinforcement sections to reinforce the strength of the lifter installation sections. The lifter installation sections having a strength lower than that of the concave-convex sections are reinforced due to the reinforcement sections, so that the lifter installation sections are prevented from being extremely being deformed during the rolling process.

10 Claims, 5 Drawing Sheets

ROTATING TUB BODY AND DRUM-TYPE WASHING MACHINE HAVING THE SAME

CROSS-REFERENCE TO RELATED APPLICATIONS

This application is a continuation of U.S. Ser. No. 12/081,600, filed Apr. 17, 2008 now U.S. Pat. No. 8,256,248, which claims the benefit of Korean Patent Application No. 10-2007-0055701 filed on Jun. 7, 2007, in the Korean Intellectual Property Office, the disclosures of which are incorporated herein by reference.

BACKGROUND

1. Field

The present invention relates to a drum type washing machine having the same. More particularly, the present invention relates to a cylindrical rotating tub body, which is formed by rolling a plate such that both ends of the plate are connected to each other, and a drum-type washing machine having the same.

2. Description of the Related Art

In general, a drum-type washing machine is a device that washes laundry loaded in a drum by moving the laundry upward and then dropping the laundry from the top to the bottom of the drum. As disclosed in Korean Patent Unexamined Publication No. 2006-107036, a drum-type laundry machine according to the related art includes a housing forming an external appearance of the washing machine, a water tub, which is installed in the housing to contain water therein, and a rotating tub, which is rotatably installed in the water tub and rotates by receiving the rotating force generated from a driving motor. Therefore, as the rotating tub rotates in the water tub, the laundry moves upward together with washing water along an inner peripheral surface of the rotating tub and then drops, so that the laundry is washed.

The rotating tub includes a cylindrical rotating tub body, which is open at a front surface and a rear surface thereof, a front cover, which covers a front surface of the rotating tub body and has an opening at a center portion thereof to allow the laundry to be introduced into the rotating tub body, and a rear cover, which covers a rear surface of the rotating tub body and receives power from the driving motor. The rotating tub is provided at an inner peripheral surface thereof with a plurality of lifters, which are spaced apart from each other in the circumferential direction to lift the laundry upward.

Recently, a drum-type washing machine capable of improving washing efficiency using a concave-convex structure has been suggested. According to the above drum-type washing machine, a plurality of concave-convex sections are provided at an inner surface of a rotating tube body such that the laundry can be washed by the friction with the inner peripheral surface of the rotating tub, and lifter installation sections are formed in the circumferential direction alternately with the concave-convex section, so that the washing performance is improved due to the concave-convex structure.

However, since the concave-convex sections and the lifter installation sections are alternately installed on the inner peripheral surface of the rotating tub body, a strength of the concave-convex sections is increased due to the irregular structure thereof, but a strength of the lifter installation section is decreased due to an installation hole to install the lifter.

Accordingly, if the rotating tub body is manufactured in a cylindrical shape by rolling a plate having a predetermined length and width after forming the concave and convex structure and the lifter installation section on the plate, the lifter installation section having a relative low strength is extremely deformed as compared with the concave-convex structure. As a result, although the rotating tub body must be uniformly deformed into the cylindrical structure through the rolling process, the rotating tub body may be irregularly deformed about the lifter installation section.

SUMMARY

Accordingly, it is an aspect of the present embodiment to provide a rotating tub body and a drum-type washing machine having the same, in which a concave-convex structure and a lifter installation section are uniformly deformed to obtain a cylindrical rotating tub body.

Additional aspects and/or advantages will be set forth in part in the description which follows and, in part, will be apparent from the description, or may be learned by practice of the invention.

The foregoing and and/or other aspects are achieved by providing a rotating tub body, which is formed in a cylindrical shape by rolling a plate having a predetermined length and width and includes lifters provided on an inner peripheral surface of the rotating tub body and spaced apart from each other, a plurality of lifter installation sections provided on the plate of the rotating tub body to install the lifters, a plurality of concave-convex sections provided on the plate alternately with the lifter installation sections, each concave-convex section including a plurality of concave-convex parts, and reinforcement sections reinforcing strength of the lifter installation sections.

Frames may be installed at both sides of the plate such that covers are able to be installed on the frames to cover both sides of the rotating tub body, and the reinforcement sections are formed on the frames corresponding to both sides of the lifter installation sections.

The reinforcement sections may extend lengthwise along the plate.

The reinforcement sections may extend such that the reinforcement sections are located above and below the concave-convex sections when viewed in a width direction of the concave-convex sections.

The reinforcement sections may be formed on the frames while being spaced apart from the concave-convex sections.

The reinforcement sections may be formed by processing a portion of the rotating tub body such that the portion is recessed at a first side of the rotating tub body and is protruded at a second side of the rotating tub body.

The concave-convex sections may be recessed in a polygonal conical shape.

A through-hole may be formed at a bottom point of each of the concave-convex sections to allow water to pass therethrough.

The reinforcement sections may have a shape identical to a shape of the concave-convex parts included in the concave-convex sections.

The reinforcement sections may be disposed in parallel to the concave-convex parts located at both edges of the concave-convex sections.

The foregoing and/or other aspects are achieved by providing a drum-type washing machine, which includes a rotating tub body having a cylindrical shape and including lifter installation sections to install lifters, concave-convex sections located alternately with the lifter installation sections in a circumferential direction of the rotating tub body and having a plurality of concave-convex parts, and reinforcement sections reinforcing strength of the lifter installation sections.

The foregoing and/or other aspects are achieved by providing a drum-type washing machine, which includes a rotating tub body having a cylindrical shape and including lifter installation sections to install lifters, concave-convex sections located alternately with the lifter installation sections in a circumferential direction of the rotating tub body and having a plurality of concave-convex parts, and reinforcement sections allowing the lifter installation sections and the concave-convex sections to be uniformly rolled into the cylindrical shape.

The foregoing and/or other aspects are achieved by providing a rotating tub body of a washing machine, including: a plurality of concave-convex sections disposed along the rotating tub body; at least one lifter installation section disposed between two of the concave-convex sections; and at least one reinforcement section disposed along an edge of the rotating tub body on a width side of the at least one lifter installation section.

The at least one reinforcement section may abut from a surface of the rotating tub body.

The foregoing and/or other aspects are achieved by providing a rotating tub body of a washing machine, including: a plurality of concave-convex sections each including a plurality of concave-convex parts disposed along the rotating tub body; at least one lifter installation section disposed between two of the concave-convex sections; and at least one reinforcement section disposed on a width side of the at least one lifter installation section and adjacent at least one of the concave-convex parts of the concave-convex sections.

The foregoing and/or other aspects are achieved by providing a rotating tub body having a cylindrical shape, including: a plurality of concave-convex sections spaced apart from each other in a circumferential direction of the rotating tub body; and a reinforcement section reinforcing a portion between two of the concave-convex sections adjacent to each other.

BRIEF DESCRIPTION OF THE DRAWINGS

These and/or other aspects and advantages will become apparent and more readily appreciated from the following description of the embodiments, taken in conjunction with the accompanying drawings of which.

DETAILED DESCRIPTION OF THE EMBODIMENTS

Figure 1:
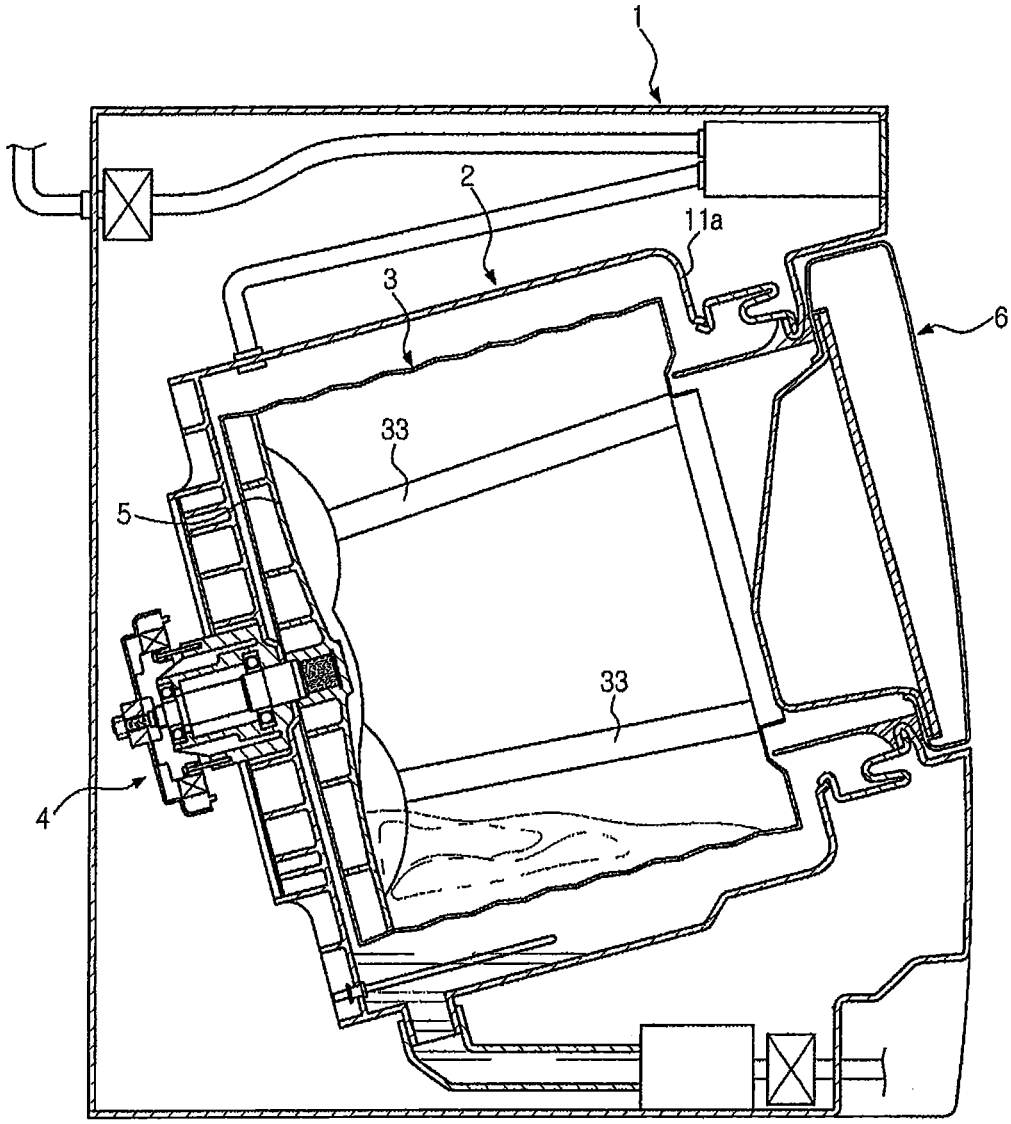
FIG. 1 is a sectional view representing a drum-type washing machine according to a first embodiment.

Reference will now be made in detail to the embodiments, examples of which are illustrated in the accompanying drawings, wherein like reference numerals refer to the like elements throughout. The embodiments are described below to explain the present invention by referring to the figures.

Hereinafter, a drum-type washing machine according to a first embodiment will be described in detail with reference to accompanying drawings.

As shown in FIG. 1, a drum-type washing machine according to the present embodiment includes a housing 1, which forms an external appearance of the washing machine, a water tub 2, which is installed in the housing to contain water therein, a rotating tub 3, which is rotatably installed in the water tub 2, a driving motor 4, which transfers power to the rotating tub 3 to rotate the rotating tub 3 such that washing and dehydration processes are performed relative to laundry loaded in the rotating tub 3, and a shaft flange 5, which is fixed to a rear surface of the rotating tub 3 such that the driving force from the driving motor 4 is uniformly transferred to the rotating tub 3.

The water tub 2 and the rotating tub 3 are open at front center portions thereof such that the laundry is able to be introduced into the rotating tub 3 or to be withdrawn from the rotating tub 3. A door 6 is hinged to the housing such that the open front portions of the water tub 2 and a rotating tub 3 are open/closed. Lifters 33 are disposed on the inner peripheral surface of the rotating tub 3 such that the laundry moves upward and drops according to a reversible rotation of the rotating tub 3, thereby washing the laundry.

Figure 2:
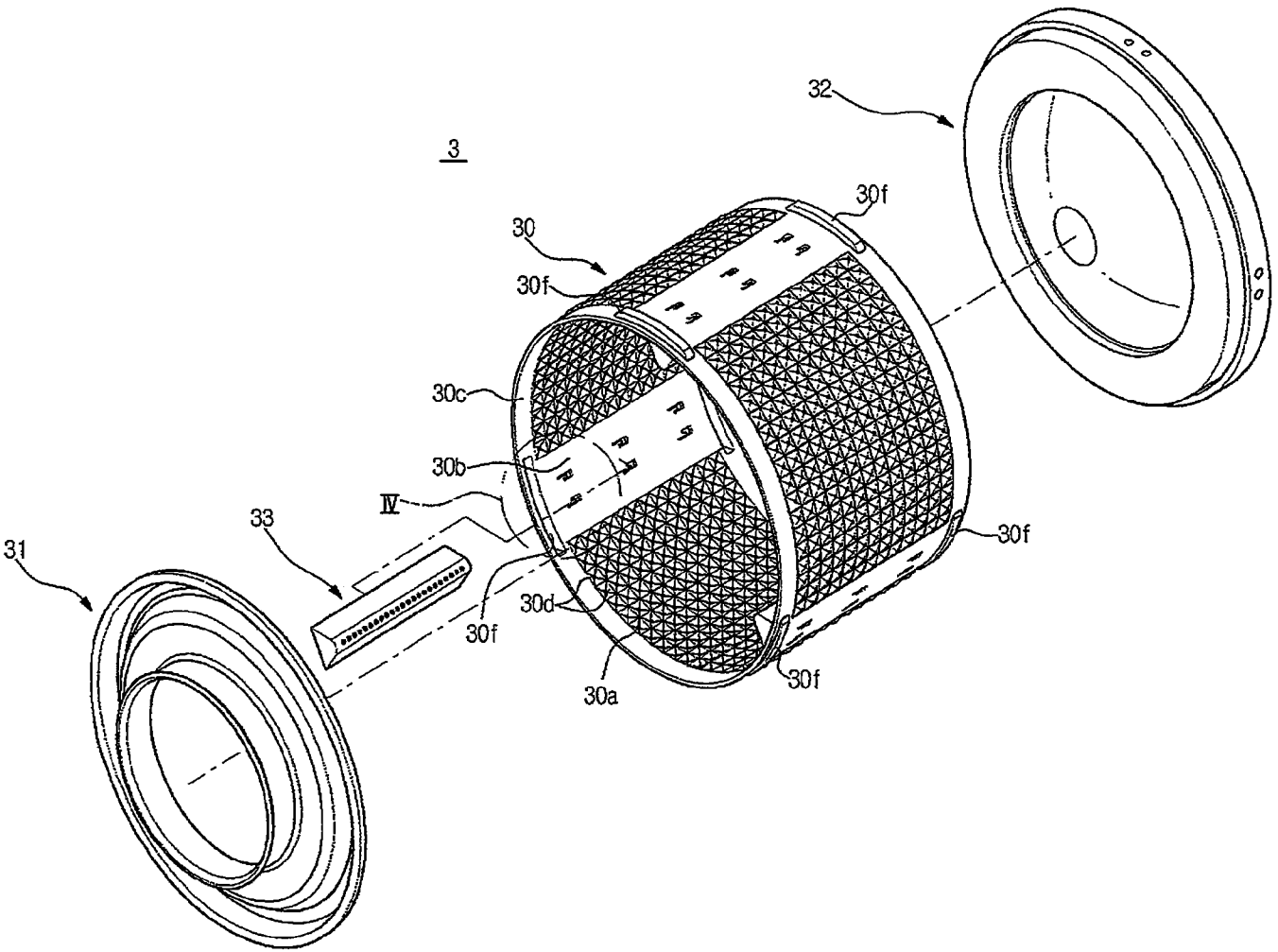
FIG. 2 is an exploded perspective view representing a rotating tub, which is applied to the drum-type washing machine according to the first embodiment.

As shown in FIG. 2, the rotating tub 3 includes a rotating tub body 30, which has a cylindrical shape and is transversely disposed with open front and rear sides, and a couple of covers 31 and 32 which cover the open front and rear sides of the rotating tub body 30. The covers 31 and 32 include a front cover 31 which is open at a center portion while covering the front side of the rotating tub 30 such that the laundry is introduced into the rotating tub 3 and a rear cover 32, which covers the rear side of the rotating tub 3 and has a shaft flange 5 fixed thereto to receive power from the driving motor 4.

Figure 3:
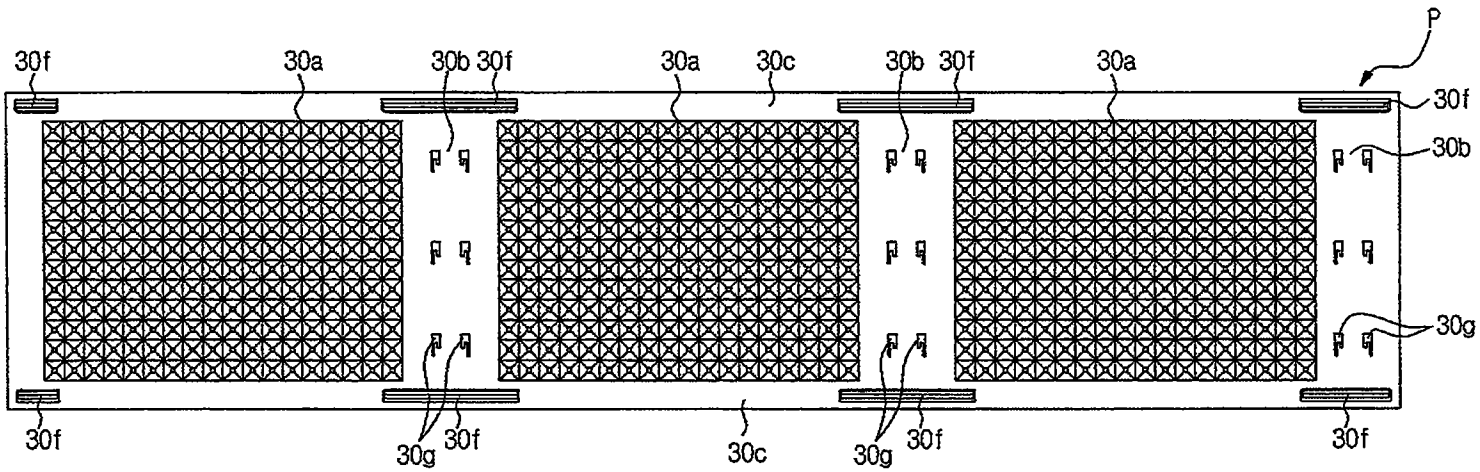
FIG. 3 is a development view representing a rotating tub body, which is applied to the drum-type washing machine according to the first embodiment.

In addition, the rotating tub 3 includes a corrosion-resistant material such as aluminum, for example. As shown in FIG. 3, a plate P having a predetermined length and width is rolled into a cylindrical shape, and then opposite ends of the plate P are connected to each other through a welding process, so that the rotating tub body 30 is fabricated. After that, the front cover 31 and the rear cover 32, which are separately fabricated, are installed at both sides of the rotating tub body 30.

Figure 4:
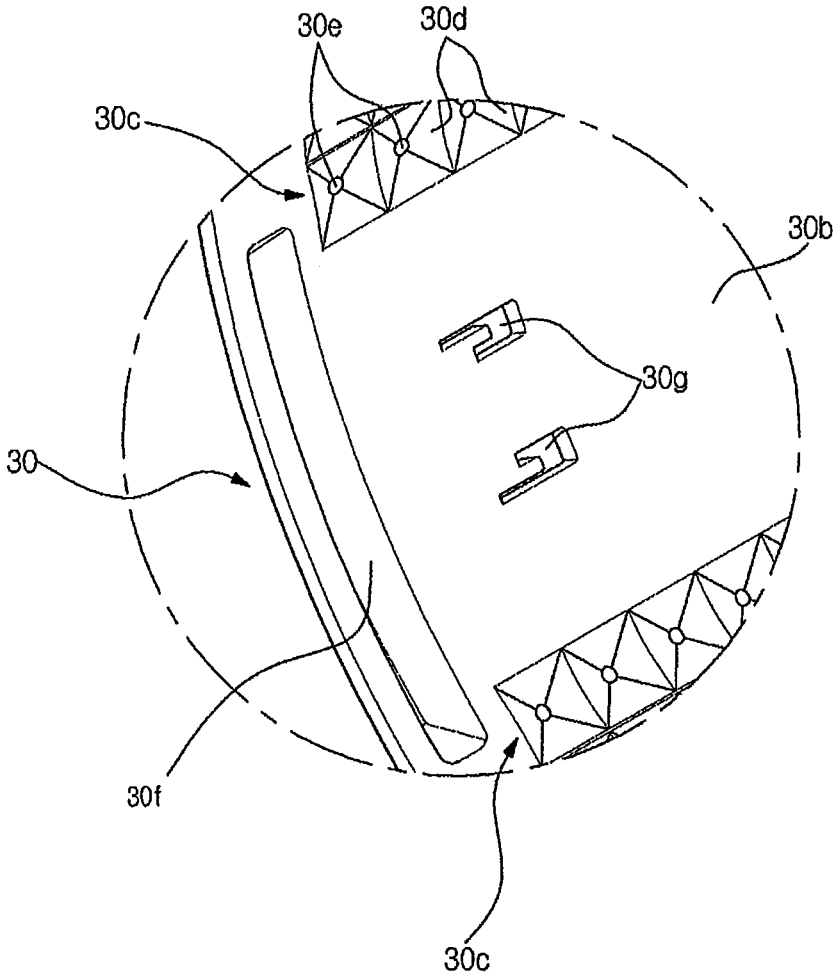
FIG. 4 is an enlarged view of IV portion shown in FIG. 2.

In the drum-type washing machine according to the present embodiment, the plate P used for the rotating tub body 30 has a plurality of concave-convex sections 30*a*, which are formed lengthwise along the plate P while being spaced apart from each other. Each concave-convex section 30*a* includes a plurality of concave-convex parts 30*d* (shown in FIG. 4) that cause friction between the laundry to effectively wash the laundry. Lifter installation sections 30*b* are installed between the concave-convex sections 30*a*. The lifter installation sections 30*b* have lifter installation holes 30*g* to install lifters 33 and are alternately formed with the concave-convex sections 30*a* lengthwise along the plate R In addition, frames 30*c* are formed at upper and lower portions of the plate P to allow the front cover 31 and the rear cover 32 to be installed thereon after the rotating tub body 30 is manufactured using the plate P. In this case, the concave-convex part 30*d* included in the concave-convex section 30*a* is formed by recessing the plate P in a polygonal-conical shape. According to the present embodiment, the concave-convex section 30*a* is recessed in a quadrangular conical shape and a through-hole 30*e* is formed at a bottom point of the concave-convex section 30*a* to allow water to pass therethrough. Accordingly, as the rolling process is performed on the above plate P and both ends of the plate P are connected to each other, the cylindrical rotating tub body 30, in which the concave-convex section 30*a* and the lifter installation section 30*b* are alternately disposed on the inner peripheral surface of the rotating tub body 30 in the circumferential direction, can be obtained. In addition, in the drum-type washing machine according to the present embodiment, a reinforcement section 30*f* is formed to reinforce the strength of the lifter installation section 30*b* such that the lifter installation section 30*b* having a low strength relative to that of the concave-convex section 30*a* is prevented from being excessively deformed in the process of forming the rotating tub body 30 by rolling the plate P. Accordingly, the concave-convex section 30*a* and the lifter installation section 30*b* are uniformly deformed due to the reinforcement section 30*f*, so that the rotating tub body 30 is manufactured into a complete cylindrical shape.

According to the present embodiment, the reinforcement sections 30*f* are formed at both sides of the lifter installation section 30*b* in the frame 30*c*, respectively. The reinforcement sections 30*f* are formed such that a portion of the plate P forming the rotating tub body 30 is recessed to one side and protrudes to the other side. In this case, since the reinforcement section 30*f* serves to prevent the lifter installation section 30*b* from being extremely deformed in the rolling process, the reinforcement section 30*f* is formed lengthwise along the plate P and extends in a circumferential direction of the rotating tub body 30 when the fabricating of the reinforcement section 30*f* is completed. In addition, the reinforcement section 30*f* extends from both ends of the lifter installation section 30*b* such that both ends of the reinforcement section 30*f* are located in the frame 30*c* corresponding to both sides of the concave-convex section 30*a*, so that a deformation is prevented from occurring at a boundary area between the concave-convex section 30*a* and the lifter installation section 30*b*. The reinforcement section 30*f* is spaced apart from the concave-convex section 30*a* by a predetermined distance in a width direction of the plate P. That is, the reinforcement sections 30*f* are formed such that circumferential end portions of the reinforcement sections 30*f* are disposed at outer sides of two concave-convex sections 30*a* that are adjacent to each other.

Accordingly, if the cylindrical rotating tub body is manufactured by rolling the plate P described above, a portion of force that has been applied to the lifter installation section 30*b* during the rolling process is supported by the reinforcement section 30*f*, so that the lifter installation section 30*b* is prevented from being excessively deformed. Accordingly, the concave-convex section 30*a* and the lifter installation section 30*b* are uniformly deformed, so that the rotating tub body 30 is manufactured in a complete cylindrical shape as compared with the conventional rotating tub body 30 without the reinforcement section 30*f*. In addition, as described above, the reinforcement sections 30*f* are formed at both sides of the lifter installation section 30*b*, so that the deformation of the lifter installation section 30*b* is prevented when the rotating tub body is manufactured into the rotating tub body 30, thereby preventing the distortion of the rotating tub body 30.

Figure 5:
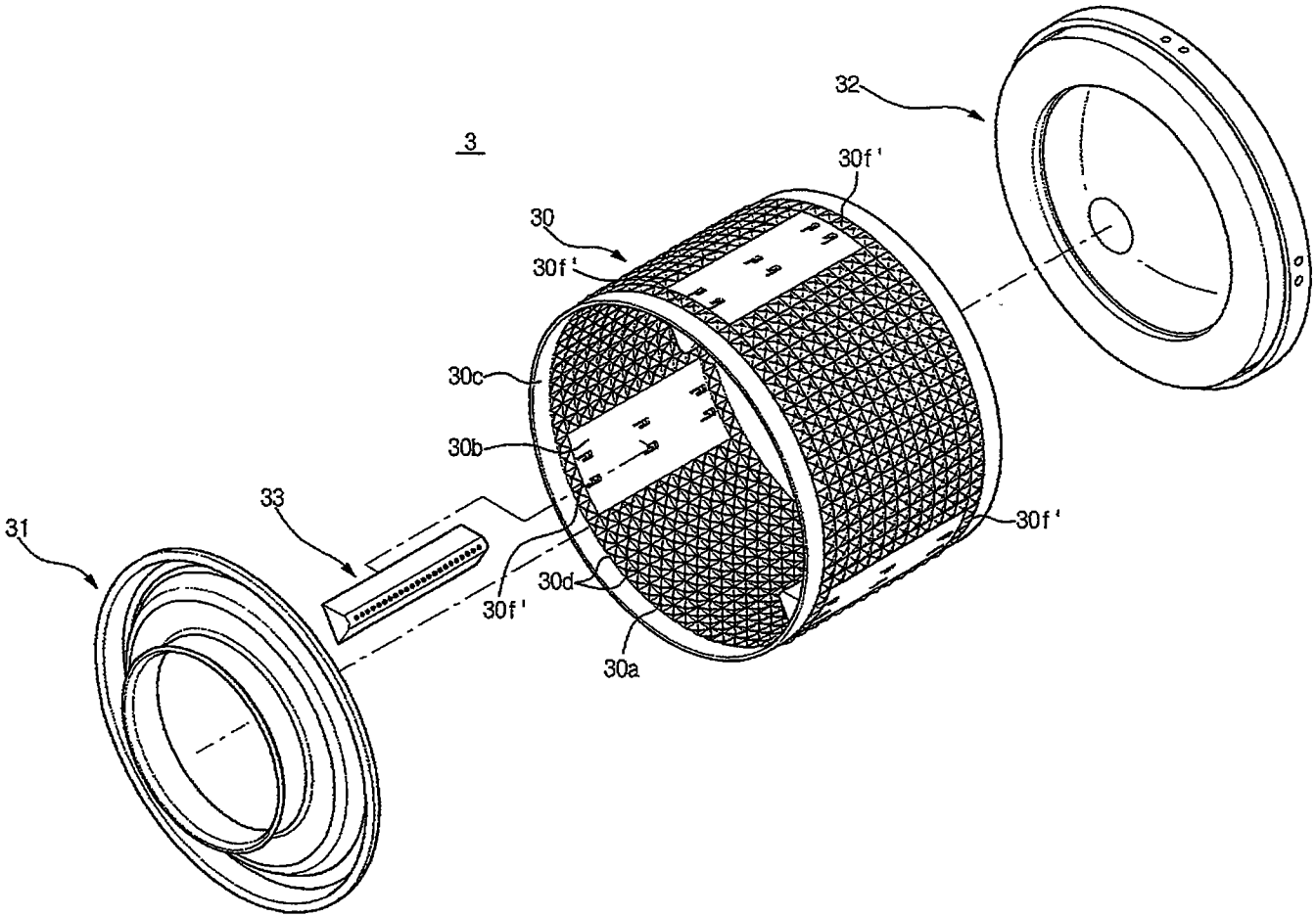
FIG. 5 is an exploded perspective view representing a rotating tub, which is applied to the drum type washing machine according to a second embodiment.

The reinforcement sections 30*f* according to the present embodiment are formed by processing the plate P such that the plate P is recessed to one side and protrudes to the other side. However, the present invention is not limited to the above embodiment. According to a second embodiment, as shown in FIG. 5, the reinforcement sections 30*f'* may have a shape substantially identical to the shape of the concave-convex part 30*d* of the concave-convex section 30*a*. In this case, each of the reinforcement sections 30*f'* is formed in parallel to the concave-convex parts 30*d* located at both edges of the concave-convex section 30*a* and extends on either side of the lifter installation section 30*b*.

According to the embodiment, a plurality of lifter installation sections 30*b* are formed on the rotating tub body 30 to mount the lifter 33 such that the lifter installation section 30*b* and the plural concave-convex sections 30*a* are alternatively formed on the rotating tub body 30, and the reinforcement section 30*f* is formed at both sides of the lifter installation section 30*b*. However, the present embodiment is not limited thereto and the reinforcement section 30*b* may be applied to a rotating tub body which does not have the lifter. That is, in the case of the rotating tub body 30 having no lifter, the lifter installation section 30*b* is not provided, so that the plural concave-convex sections 30*a* are formed on the rotating tub body 30 while being spaced apart from each other in the circumferential direction of the rotating tub body 30. In addition, the reinforcement section 30*f* extends in the circumferential direction of the rotating tub body 30 at both sides of the adjacent concave-convex sections 30*a* such that circumferentially both ends of the reinforcement section 30*f* are disposed at outer sides of the adjacent two concave-convex section 30*a*. Accordingly, a portion between the two concave-convex sections 30*a* is reinforced by the reinforcement section 30*f*.

Although the embodiment has been made in relation to a drum-type washing machine as an example, the present embodiments are not limited to the example and may be applied to another type of washing machine having a rotating tub body.

According to the present embodiments, a drum-type washing machine can reinforce a lifter installation section having a strength lower than that of a concave-convex section by using a reinforcement section so that an extreme deformation of the lifter installation section is prevented during a rolling process. Accordingly, the concave-convex section and the lifter installation section are uniformly deformed, so that a rotating tub body is manufactured in a complete cylindrical shape.

In addition, in the drum-type washing machine according to the present embodiments, the reinforcement section prevents the lifter installation section from being deformed, so that the distortion of the rotating tub body is prevented when the rotating tub body is fabricated for a rotating tub.

Although a few embodiments have been shown and described, it would be appreciated by those skilled in the art that changes may be made in these embodiments without departing from the principles and spirit of the invention, the scope of which is defined in the claims and their equivalents.

What is claimed is:

1. A drum-type washing machine, comprising:

a rotating tub body having a cylindrical shape; and a plurality of lifters provided at an inner circumferential surface of the rotating tub body while being spaced apart from each other, wherein the rotating tub body comprises a plurality of lifter installation sections configured to install the plurality of lifters thereon, respectively, a plurality of indented sections formed between the plurality of lifter installation sections by concave-convex sections, and a plurality of reinforcement sections formed at both axial ends of the plurality of the lifter installation sections by concave-convex sections, the plurality of reinforcement sections continuously extending between adjacent indented sections.

2. The drum-type washing machine of claim 1, wherein the plurality of indented sections is formed as the concave-convex sections are arranged in plurality thereof in an axial direction of the rotating tub body and a circumferential direction of the rotating tub body.

3. The drum-type washing machine of claim 1, wherein each concave-convex section forms a polygonal conical recess.

4. The drum-type washing machine of claim 1, wherein a through-hole allowing water to pass therethrough is formed at a bottom point of each of the concave-convex sections.

5. A drum-type washing machine comprising:

a housing forming an external appearance of the drum-type washing machine;

a water tub disposed at an inside the housing to contain water therein; and a rotating tub rotatably installed at an inside the water tub, wherein the rotating tub comprises a rotating tub body having a cylindrical shape; a plurality of lifters disposed at an inner circumferential surface of the rotating tub body while being spaced from each other; a front cover installed on a front edge portion of the rotating tub body; and a rear cover installed on a rear edge portion of the rotating tub body, the rotating tub body comprises a plurality of lifter installation sections configured to install the plurality of lifters thereon, respectively, a plurality of indented sections formed between the lifter installation sections by concave-convex sections, and a plurality of reinforcement sections formed between the front edge portion of the rotating tub body and the plurality of lifter installation portions and between the rear edge portion of the rotating tub body and the plurality of lifter installation portions, and the plurality of reinforcement sections extends in a circumferential direction of the rotating tub body such that both circumferential end portions of the plurality of reinforcement sections are respectively located between the front edge portion of the rotating tub body and the plurality of indented sections and between the rear edge portion of the rotating tub body and the plurality of indented sections, each of the plurality of reinforcement sections comprising a rib that is concave toward one side while being convex toward the other side.

6. The drum-type washing machine of claim 5, wherein the plurality of reinforcement sections comprises a plurality of first reinforcement sections installed between the front edge portion of the rotating tub body and the plurality of lifter installation sections, and a plurality of second reinforcement sections installed between the rear edge portion of the rotating tub body and the plurality of lifter installation sections.

7. The drum-type washing machine of claim 5, wherein each of the plurality of reinforcement sections are spaced apart from the plurality of indented sections.

8. The drum-type washing machine of claim 5, wherein the plurality of indented sections is formed as the concave-convex sections are arranged in plurality thereof in an axial direction of the rotating tub body and in a circumferential direction of the rotating tub body.

9. The drum-type washing machine of claim 5, wherein each concave-convex section forms a polygonal conical recess.

10. The drum-type washing machine of claim 5, wherein a through-hole allowing water to pass therethrough is formed at a bottom point of the concave-convex sections.

* * * * *